United States Patent [19]

Resnick et al.

[11] 4,103,389

[45] Aug. 1, 1978

[54] CLEANING UNIT

[75] Inventors: Marvin Resnick; Stanley Homer Mounts, both of Washington, Pa.

[73] Assignee: Textile Associates, Inc., Washington, Pa.

[21] Appl. No.: 670,115

[22] Filed: Mar. 25, 1976

[51] Int. Cl.[2] ..... A47L 5/38

[52] U.S. Cl. ..... 15/302; 15/306 B; 15/309; 34/70; 134/64 R; 134/122 R

[58] Field of Search ..... 134/64, 122; 34/70, 34/71, 95, 111; 15/302, 306 A, 306 B, 308, 309; 68/19

[56] References Cited

U.S. PATENT DOCUMENTS

| | | | |
|---|---|---|---|
| 1,587,444 | 6/1926 | Thomas | 15/302 X |
| 2,323,918 | 7/1943 | Kiernan | 34/70 X |
| 2,656,701 | 10/1953 | Hartenbach | 15/302 X |
| 2,729,536 | 1/1956 | Pull et al. | 15/302 X |
| 2,986,149 | 5/1961 | Van Brakel | 134/64 R |
| 3,333,291 | 8/1967 | Hondzinski | 15/302 |
| 3,574,526 | 4/1971 | Bell | 68/19 X |
| 3,772,732 | 11/1973 | Gilmore | 15/309 |

*Primary Examiner*—Christopher K. Moore
*Attorney, Agent, or Firm*—Webb, Burden, Robinson & Webb

[57] ABSTRACT

A cleaning and drying machine is provided for mats or the like having a stiff backing and a fibrous nap. An entry station which receives the mats upside down includes a beater roll positioned above the pass line for engaging the backside of the mat. A washing station receives the mats and includes two wet wash brushes, preferably operating in counterrotating directions. A rinse station then receives the mats and includes rinse sprays and a wringer roll assembly. A duct transports the mat to a drying station which is normally positioned below the rinse station and includes at least one roll assembly comprising a floating upper heated roll for engaging the nap and a lower, nonheated, preferably cooled roll for engaging the stiff backing. A final air blast removes the remaining moisture as the mat is removed from the machine by a belt conveyor.

19 Claims, 3 Drawing Figures

CLEANING UNIT

FIELD OF THE INVENTION

Our invention relates to cleaning and drying machines and, more particularly, to an automated unit for cleaning and drying floor mats having a stiff backing of a first material and bristles or fibrous nap of a second material.

DESCRIPTION OF THE PRIOR ART

Industrial mats are normally made of two different materials having different properties. The mat backing is normally rubber or vinyl and is intended to provide a fairly stiff or rigid floor engaging surface. The bristles or fibrous nap which extend outwardly from the backing are generally fibers of polypropylene, cotton, polyester or some other suitable synthetic. The rigid backing has a tendency to become distorted when exposed to the elevated temperatures necessary for drying mats which have been previously passed through wash and rinse tanks. This distortion becomes permanent upon cooling, thereby resulting in a nonflat mat with a nonrigid backing. This, of course, is unsafe and therefore that mat must be discarded.

Presently, these industrial mats are dried in special hothouse rooms separate and apart from the cleaning operation and which are heated by the circulation of hot air. The drying efficiency of such hothouse rooms is extremely low because of the many heat losses associated with such rooms. In addition, such operations require a person to feed the cleaning machine and a person to remove the mats and place them on hanging conveyors for movement into the drying rooms. Thereafter, an additional person is required to remove the mats after they leave the drying room. The fact that the mat backing tends to become plastic at elevated temperatures and loses its rigidity and form has led people away from attempts to use heated rolls to assist in the drying. In addition, rolls tend to deform the fiber nap thereby shortening the useful life of these mats. It is for these reasons that present equipment provides a dry to wet mat in a first operation and a wet mat back to a dry mat in a second operation which is independent of the first operation.

SUMMARY OF THE INVENTION

We have overcome the two-step operation presently used by providing a single operation dry to dry mat cleaning apparatus. In so doing we have eliminated the warpage and distortion of the mat backing without detracting from effective drying of the nap portion of the mat. By combining the heretofore two-stage operation into a single, continuous cleaning and drying unit, we have reduced the labor required to operate the equipment and, depending upon the operating speed utilized, one or two persons can now operate the entire unit. The result is an efficient cleaning and drying unit which does not detract from the expected, useful life of the mats being processed.

Our invention is a cleaning machine for mats having a stiff backing and a fibrous nap. The mat is inserted into the entry station with the stiff side up and this stiff side is engaged by a beater roll positioned above the pass line and a brush engaging the nap. Thereafter, the mat enters a washing tank where two counterrotating wet wash rolls engage the nap. Thereafter, the mat is subjected to a rinse tank which includes nozzles and a wringer roll assembly. The mat then passes through a closed duct into a drying station positioned below the rinse tank. This positions the mat nap side up. The mat then passes through a plurality of drying roll assemblies which include a floating upper heated roll for engaging the nap and a lower, nonheated roll, preferably cooled, for engaging the backing. As the mat leaves the drying roll assemblies, a hot air blast removes the remaining water and fluffs up the nap. A fluffing roll may also be provided for that purpose.

DESCRIPTION OF THE PREFERRED EMBODIMENTS

Figure 1:
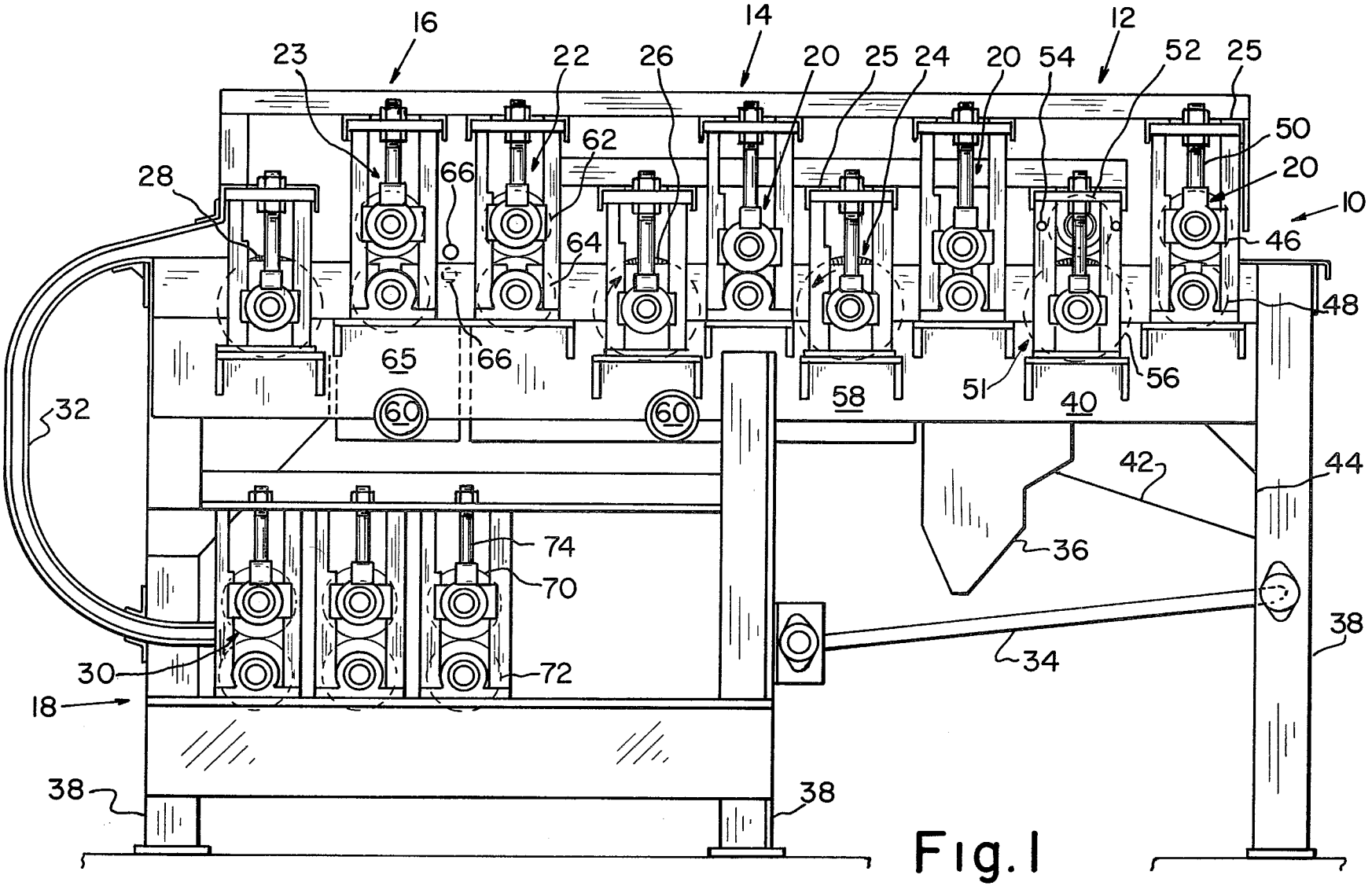
FIG. 1 is a diagrammatic view of our cleaning machine.

Our cleaning and drying machine, generally designated 10, includes an entry section 12, a washing section 14, a rinsing section 16 and a drying section 18, FIG. 1. The machine 10 is built on a plurality of main supports 38 mounted to the floor of the building housing the machine 10. The machine 10 includes two levels with the entry section 12, wash section 14 and rinse section 16 being on the upper level and the drying section 18 positioned on the lower level directly below the rinse section 16. While the preferred embodiment is described for cleaning industrial mats, it will be understood that the equipment can be dimensioned so as to accommodate other floor coverings having a rigid backing prone to distortion on heating and a fibrous nap.

The entry section 12 includes an entry tank 40, two feed roll assemblies 20 and a beater roll assembly 51. Each feed roll assembly 20 includes an upper feed roll 46 having a steel surface and a lower feed roll 48 normally coated with rubber to facilitate passing the mats therethrough. Each feed roll assembly 20 is mounted on standard pillow block bearings which accommodate the roll necks. The rolls are stationarily mounted with the upper roll 46 suspended from adjustable mounts 50 extending from a take-up housing 25. This permits the roll nip to be adjusted for different thickness mats and/or for wear of the respective upper and lower rolls 46 and 48. The take-up housing, roll mounts and pillow block bearings are standard items and do not form a part of this invention.

Positioned between the two feed roll assemblies 20 is a roll assembly 51 made up of an upper beater roll 52 and a lower brush roll 56. The feed roll assemblies 20 and beater roll assembly 51 are positioned along the pass line of the mats being processed. The beater roll 52 includes 5/16 inch steel rods 54 mounted to the roll which beat on the backside of the mat as nylon fibers on the brush roll 56 engage the nap side of the mat. The result is that a substantial amount of dirt is removed or at least loosened in the entry section 12. The floor 42 of the entry tank 40 is sloped so that the dirt particles collect at the lower end of the inclined floor 42 where they are removed through a cleanout door 44.

The washing section 14 is adjacent the entry section. Washing section 14 comprises a washing tank 58 which accommodates the hot water, normally at temperatures up to 150° F, and the cleaning detergent. Within the wash tank 58 are mounted a first wet washing brush 24 and a second wet washing brush 26 positioned in spaced apart relationship along the pass line. The respective wet washing brushes 24 and 26 are mounted in standard take-up housings with each brush engaging the nap portion of the mat. The respective brushes 24 and 26 are adapted to rotate in opposing directions so as to maximize their cleaning ability. Finger guides (not shown) are positioned over the washing brushes to maintain alignment and stabilize the mats. Positioned intermediate of the two wet washing brushes 24 and 26 is a feed roll assembly 20 identical with that previously described.

Adjacent the second wet wash brush 26 and positioned along the pass line is a wringer roll assembly 22. Wringer roll assembly 22 is comprised of upper wringer roll 62 and bottom wringer roll 64 which are generally both rubber coated to act as a squeegee on the mats which have been thoroughly scrubbed and exposed to hot water and detergent in the wash tank 58. A suitable wash tank drain 60 is positioned at the bottom of wash tank 58 to continuously drain the tank as the need arises.

Adjacent the wash section 14 is rinse section 16. Rinse section 16 includes a rinse tank 65 having an appropriate drain 68 positioned at the bottom thereof. Spray nozzles 66 are positioned on either side of and adjacent the pass line so as to eject a water rinse spray against the mat passing therealong. A wringer roll assembly 23 similar to the wringer roll assembly 22 is positioned within the rinse tank 65.

All of the roll assemblies are operated in synchronization by standard drive means (not shown). The various roll assemblies are spaced so that a given mat is normally engaged by a number of roll assemblies along the pass line at the same time so as to insure their continuous feed through the cleaning and drying machine 10.

A fluffing brush 28 is illustrated along the pass line immediately adjacent the rinse section 16. This fluffing brush 28 acts to straighten up the nap of the mat. The fluffing brush 28 is not deemed critical at this stage of processing and it may be replaced by a simple idler roll or it may be positioned after the drying section 18 if the hot air blast 36 to be described hereinafter is deemed inadequate to properly fluff the nap.

Positioned below the rinse section on the lower level is the drying section 18. A U-shaped duct 32 bolted to the machine 10 at the opposite end from the mat entry communicates the upper level of the cleaning machine 10 with the lower level which includes the drying section 18. U-shaped duct 32 is closed and is positioned so as to receive the mat out of the wringer roll assembly 23 and the fluffing brush 28 or idler roll, and direct the mat into the pass line of the drying roll assemblies 30 in the drying section 18. Because of the change of level and the U-shape of duct 32, the mat is inverted so that the nap side of the mat is now positioned up going into the drying section 18.

The drying section 18 includes a plurality of drying roll assemblies 30. Three such assemblies are illustrated and space is shown for more. The number of drying roll assemblies 30 utilized is dependent upon the size of the mat, the type of mat being cleaned and the speed range within which the cleaning machine 10 is intended to operate. In other words, the more drying roll assemblies 30 that are employed, the faster the entire machine 10 can be operated since drying is a function of surface area contact, i.e. the number of rolls.

Each drying roll assembly 30 is comprised of an upper heated roll 70 and a lower cooled roll 72. The purpose of the heated roll 70 is to engage the nap of the mat and perform the drying function. The purpose of the cooled roll 72 is to engage the stiff backing of the mat, keeping the mat backing at a relatively low temperature and thereby eliminating distortion and/or warpage normally associated with rubber or vinyl backing subjected to increased drying temperatures. Certain natural and synthetic backings will withstand more temperature without distorting than others, in which case standard lower rolls may be used, i.e. rolls that are neither heated nor cooled.

Figure 2:
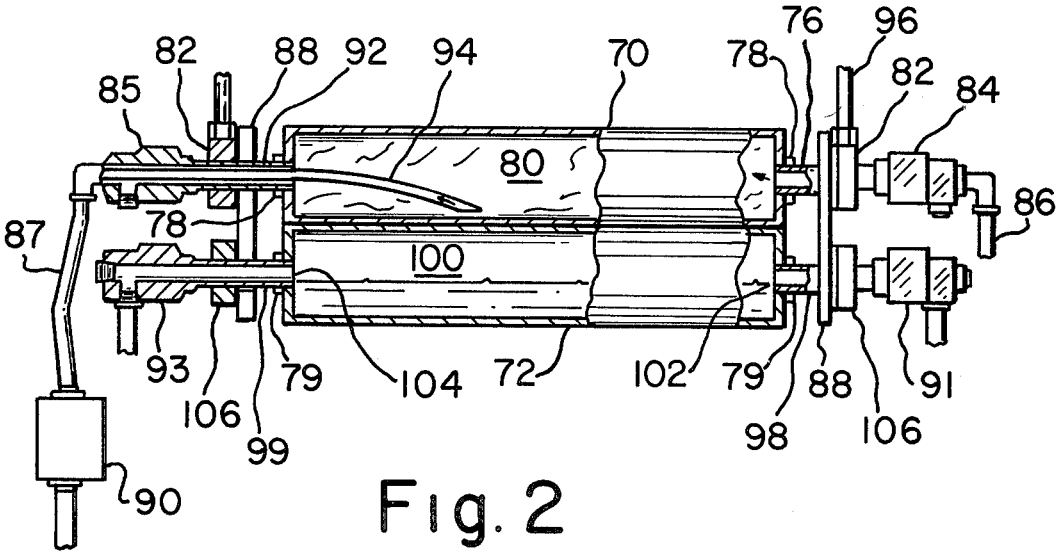
FIG. 2 is a view partly in section showing the drying roll assembly.
Figure 3:
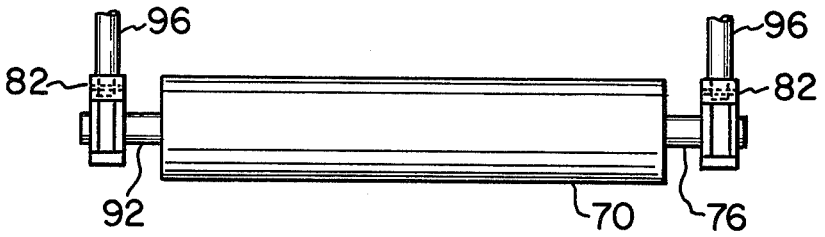
FIG. 3 is an elevation of the heated, upper roll.

There are a number of ways to heat rolls and for illustrative purposes we have shown a steam heated upper roll 70, see FIGS. 2 and 3. Roll 70 is hollow having an internal roll chamber 80 therein. A hollow roll neck 76 connects to one end of roll 70 and communicates with chamber 80, whereas hollow roll neck 92 is connected to the other end of roll 70 in communication with chamber 80. These hollow roll necks 76, 92 are further supported by welded shoulder 78 mounted to the respective roll ends. Each roll neck extends through the welded shoulder 78 and through the mounting plate 88 for take-up bearings 82. The roll neck 76 terminates within a rotating union 84 having appropriate seals and which has a stationary portion coupled to flexible hosing 86 through which the steam passes into the roll chamber 80. The hosing is flexible to accommodate vibration and permit vertical adjustment.

Roll neck 92 likewise terminates in a rotating union 85 having suitable seals (not shown). A nonrotating condensate pipe 94 extends through the hollow portion of the roll neck 92 into the chamber 80 and exits adjacent the interior wall of heated roll 70 which defines chamber 80. The opposite end of condensate pipe 94 extends from roll neck 92 and terminates in an appropriate fitting and flexible hosing 86 which passes through a steam trap 90 and into the atmosphere.

The upper roll 70 is merely suspended from a standard take-up housing through roll mount 96 which connects to the take-up bearing 82, FIG. 3. Therefore, the mounting of the upper heating rolls 70 differs from the previous roll assemblies in one important respect. The various upper rolls in the upper level of machine 10 were rigidly mounted into the roll housings even though they were adjustable as described hereinbefore. By merely suspending the roll mounts 74, the roll 70 is free to move upward along its vertical axis and, therefore, only the weight of the roll bears upon the nap of the mat passing therethrough. This then allows for a proper drying function without unduly matting down the nap of the mat.

The bottom roll 72 is hollow so as to include an internal cooling chamber 100, FIG. 2. The respective roll necks 98 and 99 are also hollow so as to include a water inlet 102 at one end and a water exit 104 at the other. Roll neck 98 extends through welded shoulder 79, mounting plate 88, pillow box bearing assembly 106 and rotating union 91 through which passes circulating cooling water. In the same manner, the roll neck 99, which includes the exit fitting 104, extends through weld plate 79, bearing mounting plate 88, pillow box bearing assembly 106 and rotating union 93. Cold water is merely circulated through the rolls during use so as to cool the mat backing and assure against warpage and distortion.

A belt conveyor 34 transports the mats out of the drying section 18. Positioned above belt conveyor 34 is a final hot air blast assembly 36 which directs its hot air blast against the nap of the mat. This hot air blast is generally necessary since while the mats are warm, some water is retained within the hot air and as the mats leave the drying section 18, some condensate is obtained which can then be removed by the hot air blast. The hot air blast further fluffs the nap of the mat thereby avoiding the necessity of a separate fluffing roll such as assembly 28 which, if utilized, is placed above the pass line since the mat is nap side up. Other auxiliary equipment can be utilized such as a final oil spray on the dry mat to control dust during use. Further, the belt conveyor 34 can extend throughout the drying section to convey the mats therethrough.

The operation of the apparatus includes feeding a mat nap side down through an entry station including a top beater, a washing station including counterrotating washing brushes, a rinse tank having feed rollers and spray nozzles and thereafter conveying the mat to a lower level which inverts the mat and communicates the mat with a plurality of drying rolls in which the upper roll is heated and the lower roll may be cooled. All rolls are rigidly mounted and adjustable for wear and the like with the heated rolls of the drying section being merely suspended rather than rigidly mounted. The upper and lower levels of the machine are sufficiently spaced so that a given mat will be engaged by at least one roll assembly in both the top and bottom levels so as to assure continuous movement throughout the operation.

We claim:

1. In a cleaning machine having a plurality of stations for cleaning and rinsing mats or the like having a stiff backing and a fibrous nap passing therethrough, the improvement comprising a drying station including at least one roll assembly, said roll assembly including a heated first roll for engaging the fibrous nap and an unheated second roll positioned in vertical alignment with the first roll to define a pass line therebetween for engaging the stiff backing.

2. The cleaning machine of claim 1, said second roll being cooled.

3. The cleaning machine of claim 2, said second roll being hollow and means associated with the roll for circulating water therethrough.

4. The cleaning machine of claim 1, said roll assembly positioned below said cleaning and rinsing stations and said improvement including guide means communicating a last station of the cleaning and rinsing stations with said roll assembly so as to invert and position the mat at said pass line.

5. The cleaning machine of claim 4, said guide means comprising a substantially U-shaped closed duct.

6. The cleaning machine of claim 1, said first roll positioned above said second roll and mounting means connected between the machine and said first roll to suspend said first roll and permit it to freely move along a vertical axis.

7. The cleaning assembly of claim 1, said heated roll being hollow and means associated at one end of the roll for introducing steam and means associated at an opposing end of the roll for exiting water condensate of the steam.

8. A cleaning machine for mats having a stiff backing and a fibrous nap comprising:

A. an entry station for receiving the mats stiff backing side up, said entry station including at least one feed roll assembly and a beater roll positioned above a pass line of the mat for beating the stiff back;

B. a washing station adjacent the entry station for receiving the mats, said washing station including a soap tank having mounted therein at least one wet wash brush roll for engaging the nap;

C. a rinse station adjacent the wash station for receiving the washed mats, said rinse station including a rinse tank and a wringer roll assembly for passing the mats therethrough;

D. a drying station positioned below the rinse stations, said drying station including at least one roll assembly, said roll assembly comprising a floating upper heated roll for engaging the nap and a lower nonheated roll for engaging the backing; and E. a duct means communicating between the rinse station and the drying station for inverting the mats so as to feed the mats nap side up into the drying station.

9. The cleaning machine of claim 8, said entry station including a roll brush positioned beneath the beater roll so as to define the pass line therebetween.

10. The cleaning machine of claim 8, said entry station including a sloped floor terminating at a cleanout door.

11. The cleaning machine of claim 8, said washing station further including a second wet wash brush roll mounted therein said brush rolls being spaced apart and adapted to rotate in opposing directions.

12. The cleaning machine of claim 11, said wet brush rolls separated by a feed roll assembly positioned therebetween and a wringer roll assembly positioned along the pass line adjacent the second wet brush roll.

13. The cleaning machine of claim 8, said rinse station including a plurality of nozzles positioned to spray a rinse against the mats passing therethrough.

14. The cleaning machine of claim 8, said lower nonheated roll in the drying station comprising a water cooled roll.

15. The cleaning machine of claim 8, said drying station including a plurality of roll assemblies positioned in spaced apart relationship along the pass line.

16. The cleaning machine of claim 8, said duct means comprising a U-shaped closed duct.

17. The cleaning machine of claim 16, said rinse station and said drying station spaced apart and said duct so dimensioned so that a mat is engaged by both the wringer roll assembly and the roll assembly at the same time.

18. The cleaning machine of claim 8 including a belt conveyor communicating with the drying station for conveying the mats therefrom and hot air blast means positioned adjacent the conveyor for directing a hot air blast against the mat.

19. The cleaning machine of claim 8 including a fluffing roll positioned adjacent the drying station for engagement with the nap.

* * * * *